US005362933A

United States Patent [19]

Kutsche et al.

[11] Patent Number: 5,362,933

[45] Date of Patent: Nov. 8, 1994

[54] ELECTRICAL SWITCHING DEVICES, IN PARTICULAR LOW VOLTAGE POWER CIRCUIT BREAKERS

[75] Inventors: Wolfgang Kutsche, Königswinter; Wolfgang Kremers, Bonn; Andreas Baldewein, Bonn; Gerd Hentschel, Bonn; Gerd Voiss, Cologne, all of Germany

[73] Assignee: Klöckner Moeller GmbH, Bonn, Germany

[21] Appl. No.: 33,645

[22] Filed: Mar. 17, 1993

[30] Foreign Application Priority Data

Mar. 17, 1992 [DE] Germany ..... 9203533[U]

[51] Int. Cl.[5] ..... H01H 23/00

[52] U.S. Cl. ..... 200/401; 200/333; 200/293; 16/376

[58] Field of Search ..... 200/401, 293, 333, 43.14, 200/43.22; 361/610, 616; 16/374, 376, 254, 260, 250, 255, 261, 221

[56] References Cited

U.S. PATENT DOCUMENTS

| | | | |
|---|---|---|---|
| 2,268,943 | 1/1942 | Johansson | 200/223 |
| 3,054,880 | 9/1962 | Harman, Jr. | 200/330 |
| 3,970,808 | 7/1976 | Gryctko et al. | 200/293 |
| 4,345,354 | 8/1982 | Ichikawa | 16/260 |
| 5,157,577 | 10/1992 | Balaud et al. | 200/43.22 |
| 5,219,070 | 6/1993 | Grunert et al. | 200/330 |
| 5,286,935 | 2/1994 | Mina et al. | 200/331 |

FOREIGN PATENT DOCUMENTS

| | | |
|---|---|---|
| 0038289 | 10/1981 | European Pat. Off. . |
| 0274624 | 7/1988 | European Pat. Off. . |
| 8211186 | 8/1982 | Germany . |
| 274624 | 11/1987 | Germany . |

*Primary Examiner*—Henry J. Recla
*Assistant Examiner*—David J. Walczak
*Attorney, Agent, or Firm*—Nils H. Ljungman & Associates

[57] ABSTRACT

An electrical switching device such as a low voltage power circuit breaker, can have a cover with a slot-like opening for providing access to a switch lever of the switching device. The cover can extend to cover over any chambers for shunt releases and/or auxiliary switches etc. which chambers can be located on both sides of the switch lever within the enclosure. The cover can also have fastening devices for attachment of a mechanical rotary actuator or a motor drive. The cover is connected to the enclosure in a manner which provides for a simple opening and closing of the cover, and essentially eliminates the danger of losing and mixing up such covers. The cover is designed with bearing legs which are bent at an angle of 90 degrees in relation to the cover plane. The bearing legs are preferably parallel to one another and laterally overlap the enclosure. The cover is mounted to the enclosure by means of the bearing legs and pivot bearing with coaxially interlocking pivots and pivot bearing openings.

20 Claims, 7 Drawing Sheets

ELECTRICAL SWITCHING DEVICES, IN PARTICULAR LOW VOLTAGE POWER CIRCUIT BREAKERS

BACKGROUND OF THE INVENTION

1. Field of the Invention

This invention generally relates to electrical switching devices such as power circuit breakers. One such device is a low voltage power circuit breaker. Such devices typically have a housing enclosing the electrical components, and a cover through which there can be access to a switch. The switch can be, in particular, a toggle type switch, and the cover can have a slot-like opening therein through which a toggle lever of the switch passes. Within the housing, there can also be various connection devices for connecting incoming and outgoing power lines, as well as various other switching devices or shunts. These auxiliary devices can be located in various chambers disposed about the toggle switch. Some of these various other devices can have metered settings which are adjustable to vary the functioning of the switching devices, and since the cover generally extends to cover these devices as well, the cover can have windows therein to enable the settings to be viewed without having to remove the cover. The cover may also have fastening devices for fastening a mechanical rotary actuator or even a motor drive thereto for actuating the toggle switch.

2. Background Information

On electrical switching devices with toggle activation, and in particular on low voltage power circuit breakers, the front of the breaker enclosure can be covered with a cover, which can have a slot-shaped opening for the toggle of the switching mechanism. On both lateral sides of the slot-shaped opening in the cover, there can be fastening devices for attaching the mechanical rotary actuator or a motor drive for operation of the toggle switch. As described above, the cover can also cover chambers for shunt releases and/or auxiliary switches, etc., which can be located around the toggle lever in the breaker enclosure.

Such covers are conventionally fastened to the breaker enclosure by means of screws. As such, switching devices typically require a comparatively complex and expensive assembly and installation process. In circumstances where the cover needs to be opened, e.g. to replace the shunt releases and/or auxiliary switches located next to the toggle lever in the breaker enclosure, the screws holding the cover in place must be completely removed. The cover and the screws would then have to be set down wherever there is space. In the event of an interruption in the installation activities, the cover and the screws could possibly be misplaced or moved, and thus could be lost. If installation work is being performed simultaneously on several switching devices located next to one another, it would also be very easy to mix up the covers of the devices, and therefore require additional time in replacing the covers as the covers would need to be sorted out to match the appropriate cover with the appropriate housing. In particular, a switching of covers generally must be avoided if the switching devices are of different designs and if certain messages and symbols appear on the covers which differ from one switching device to another.

On such covers which are screwed into place, a comparatively complex and expensive installation process is also generally necessary if, for example, a mechanical rotary actuator for the toggle lever is fastened to the cover and is to be replaced by a motor drive. The rotary actuator can, like the motor drive, be bolted partly directly to the switching device housing and partly to an installation plate or to the door of the breaker enclosure.

OBJECT OF THE INVENTION

The Object of the invention is to design a switching device such as a low voltage circuit breaker which has a cover with a slot-like opening for the toggle lever of the switching mechanism, fastening devices for a mechanical rotary actuator or a motor drive, and which covers the chambers for shunt releases and/or auxiliary switches etc., located adjacent the toggle lever on the breaker enclosure. In particular, the cover should have provisions for fastening rotary actuators. Thus, a cover for a switching device is desired which, on one hand, simplifies the installation work for closing and opening the cover, and on the other hand reduces the risk of mixing up the covers of different types of switching devices, as well as the danger of misplacing the covers, in the simplest and easiest manner possible.

SUMMARY OF TEE INVENTION

This object is achieved in a switching device having a cover which is designed with bearing legs for hingedly attaching the cover to the enclosure. The bearing legs are preferably bent at an angle of about 90 degrees in relation to a primary plane of the cover. The legs are preferably parallel to one another and preferably laterally overlap the enclosure. The cover, by means of the bearing legs, can then be mounted to the enclosure by a pivot bearing. The pivot bearing between the legs and the enclosure would essentially have coaxially interlocking pivots and pivot bearing openings so that the cover can swing out away from the enclosure to provide access to the interior of the enclosure.

The switching device of the present invention has the advantage that the cover, by means of the pivot bearing on the breaker enclosure, can be held captive by means of a minimum number of screws, and when the cover is open, does not interfere with the installation of suitable shunt releases and/or auxiliary switches in the spaces provided adjacent the toggle lever of the switching device.

Particularly advantageous refinements of the invention are disclosed herebelow.

The bearing legs of the cover can preferably be designed as flexible bearing clips which can be engaged by means of interlocking pivot and pivot bearing openings on the side walls of the breaker enclosure. This flexibility also can preferably permit the cover to be easily removed and replaced at any time. The removability of the cover is advantageous in particular if, for example, a mechanical rotary actuator for the toggle lever of the latching mechanism is fastened on the cover, and the rotary actuator is to be replaced by a motor drive. An assembled unit of the cover and attached mechanical rotary actuator could then simply be replaced by a corresponding assembled unit of a cover and a motor actuator simply by removing the old cover and clipping the new cover onto the breaker enclosure.

The cover can also preferably have a projecting step-shaped flat extension in the vicinity of the fastening location of the rotary actuator. This step-shaped extension can then serve as a base for the housing of the rotary actuator. For a secure fastening of the rotary actuator on the cover, it is also advantageous if the inside dimensions of the housing of the rotary actuator correspond to the outside dimensions of the step-shaped extension, so that the housing overlaps the extension about the periphery of the extension, and can possibly simply be snapped into place. The cover can also have several openings or holes for screws to thereby enable the rotary actuator for the switching mechanism to be fastened to the step-shaped extension from the inside of the cover. These openings or holes can be disposed on both sides of the recess for the toggle lever of the latching mechanism, and can preferably be covered over, on the front side of the cover by a thin, film-like wall part which can easily be punctured when the holes or openings are needed.

In an area of the cover below the area where it covers the switching mechanism and the chambers for shunt releases and/or auxiliary switches, it can be advantageous to provide a masking panel with window-like openings. The openings can then make it possible to read dial settings on devices located below the switching mechanism, which devices could include a release block, or an adjustable tripping device. The surfaces of the cover on both sides of the toggle lever can preferably be used to hold identification and rating signs, while the masking panel can be used to protect the tripping device against unauthorized manipulations while allowing the dial settings to be read.

To protect the enclosure from unauthorized access, an additional feature of the invention provides an opening on preferably one of the two long edges of the cover, through which opening a sealing wire or device can be passed. Any breakage of the wire or seal would then easily be seen to indicate that an unauthorized opening of the cover has occurred.

It is also particularly advantageous if the cover is preferably made of an elastic, deformation-resistant plastic, such as polycarbonate or polyester thermoplastic. Such a material would give the legs sufficient elasticity to allow the legs to be released from the pivot bearings for removal of the cover from the enclosure, while also giving the legs, articulated with the pivot bearings, a sufficient strength for clipping and maintaining the cover on the breaker enclosure.

The bearing legs of the cover can also have edge stops on the end which are bent at an angle in relation to the front of the cover. Thus, when the enclosure is mounted on a vertical surface, these edge stops can preferably come into contact against vertical mating edge stops on the side walls of the enclosure and thereby hold the cover in an essentially horizontal position, or in effect, about 90° with respect to a closed position of the cover on the enclosure. The side walls of the enclosure can preferably be at least partially recessed in relation to the front side of the breaker enclosure next to the interlocking pivots and pivot bearing openings. These recesses would essentially only need to be large enough to accommodate the bearing legs of the cover, but could be of varying sizes if desired. Consequently the open cover can be held securely in the horizontal position, and during installation or replacement proceedings, can thus be used as a shelf for small parts, e.g. auxiliary switches etc.

On the other hand, if a rotary actuator, or other device which is relatively heavy, is installed on the cover, or when an actuator linkage places an excessive load on the cover, the stops can be eliminated to enable the cover to swing freely down into a completely open position on the breaker enclosure, or in other words, through an angle of about 180° with respect to the closed position of the cover.

BRIEF DESCRIPTION OF THE DRAWINGS

Preferred embodiments of the invention are schematically illustrated in the accompanying drawings, in which.

DESCRIPTION OF THE PREFERRED EMBODIMENTS

Figure 1:
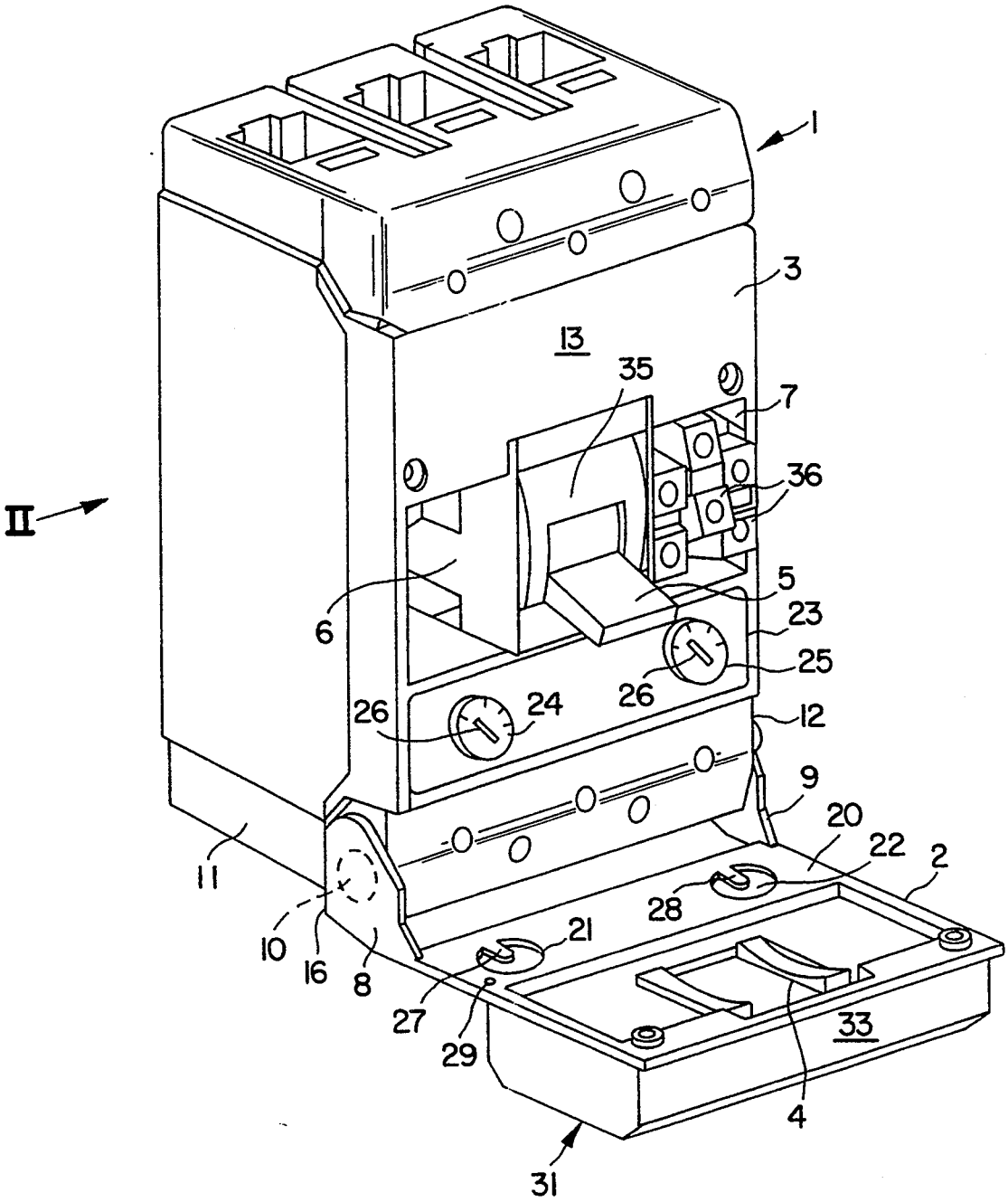
FIG. 1 shows a low-voltage power circuit breaker in a front perspective view, with the cover swung down from the front side of the breaker enclosure.
Figure 1A:
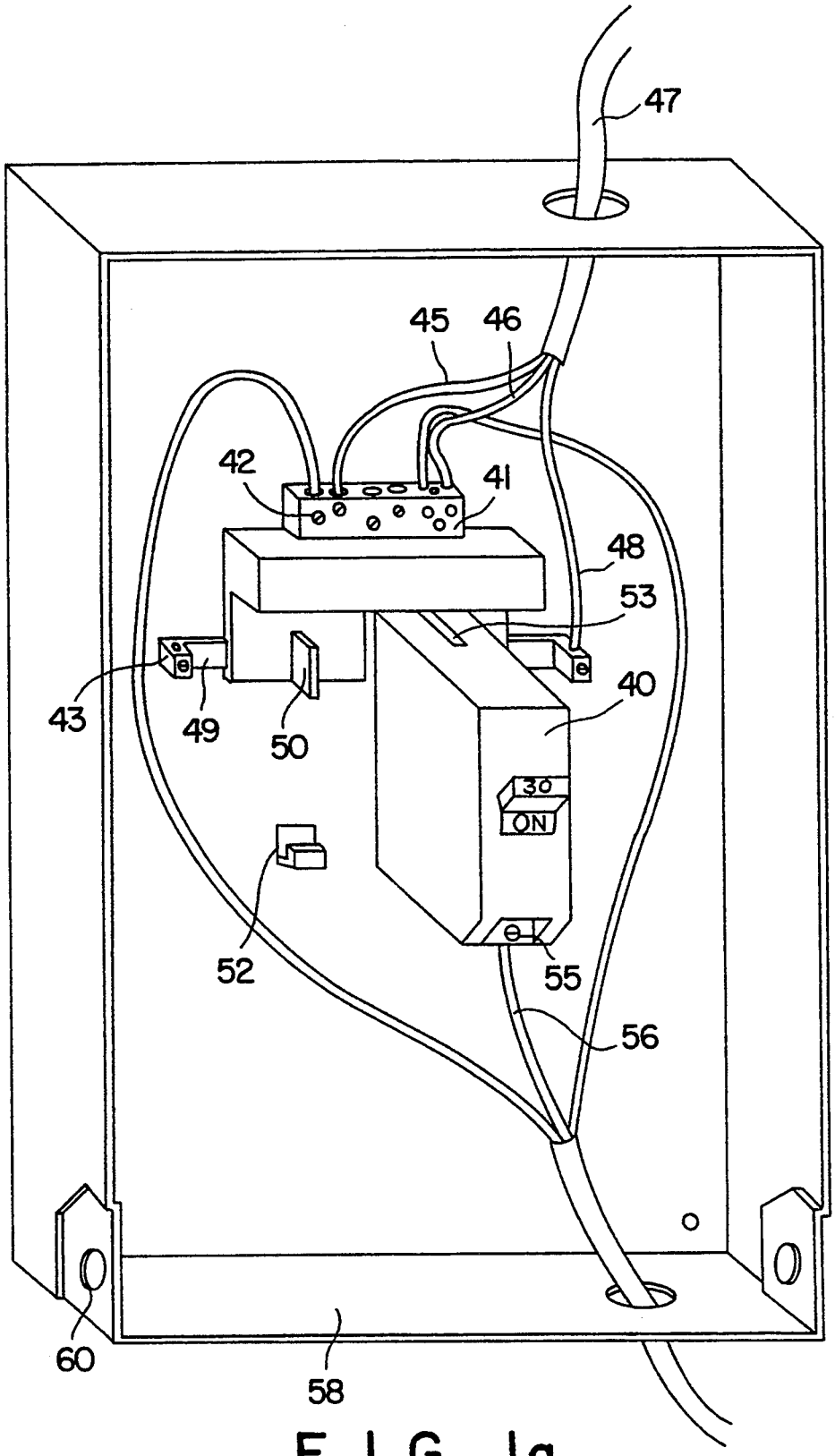
FIG. 1*a* shows one type of switching device, namely a circuit breaker enclosure.
Figure 1B:
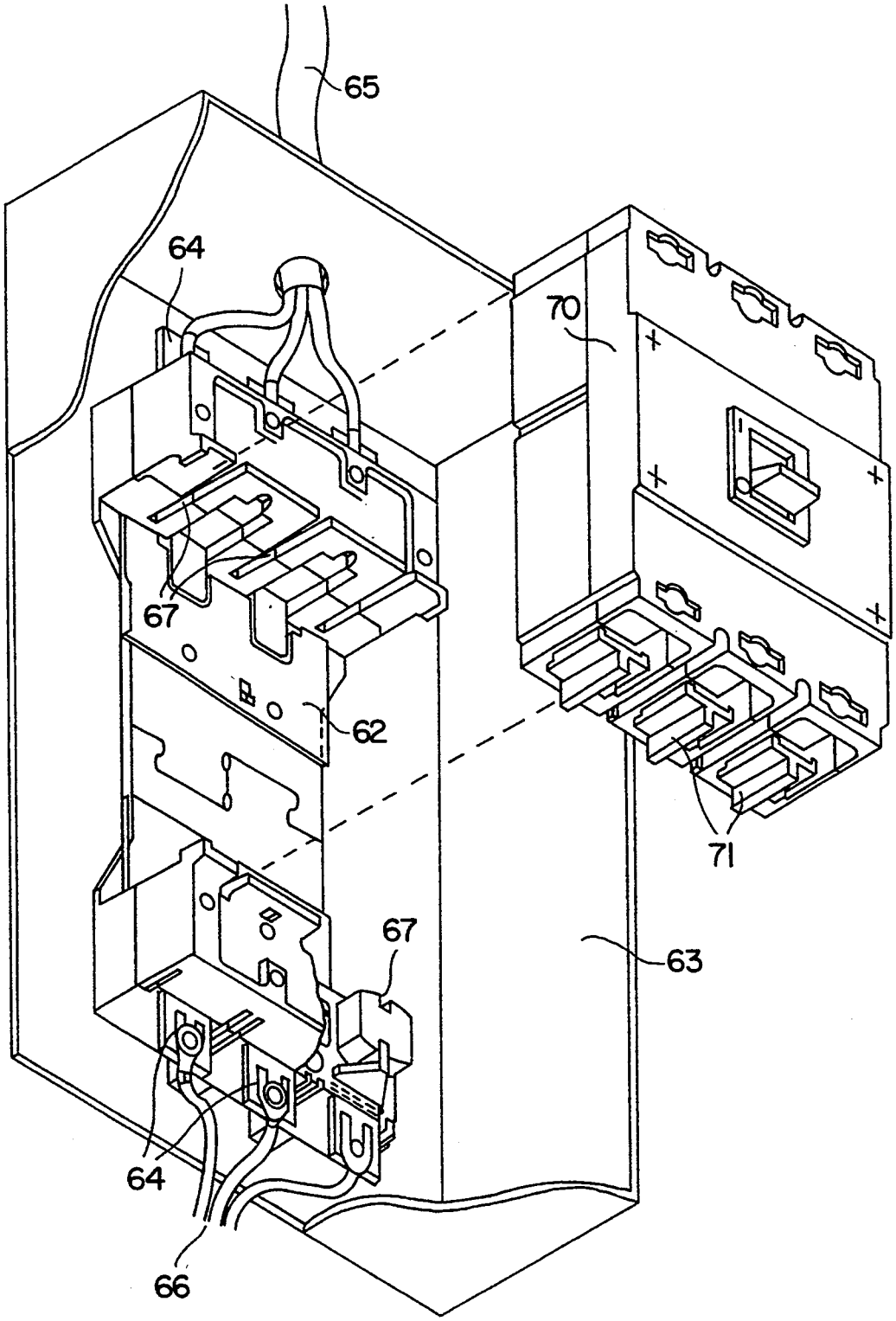
FIG. 1*b* shows another type of switching device.
Figure 1C:
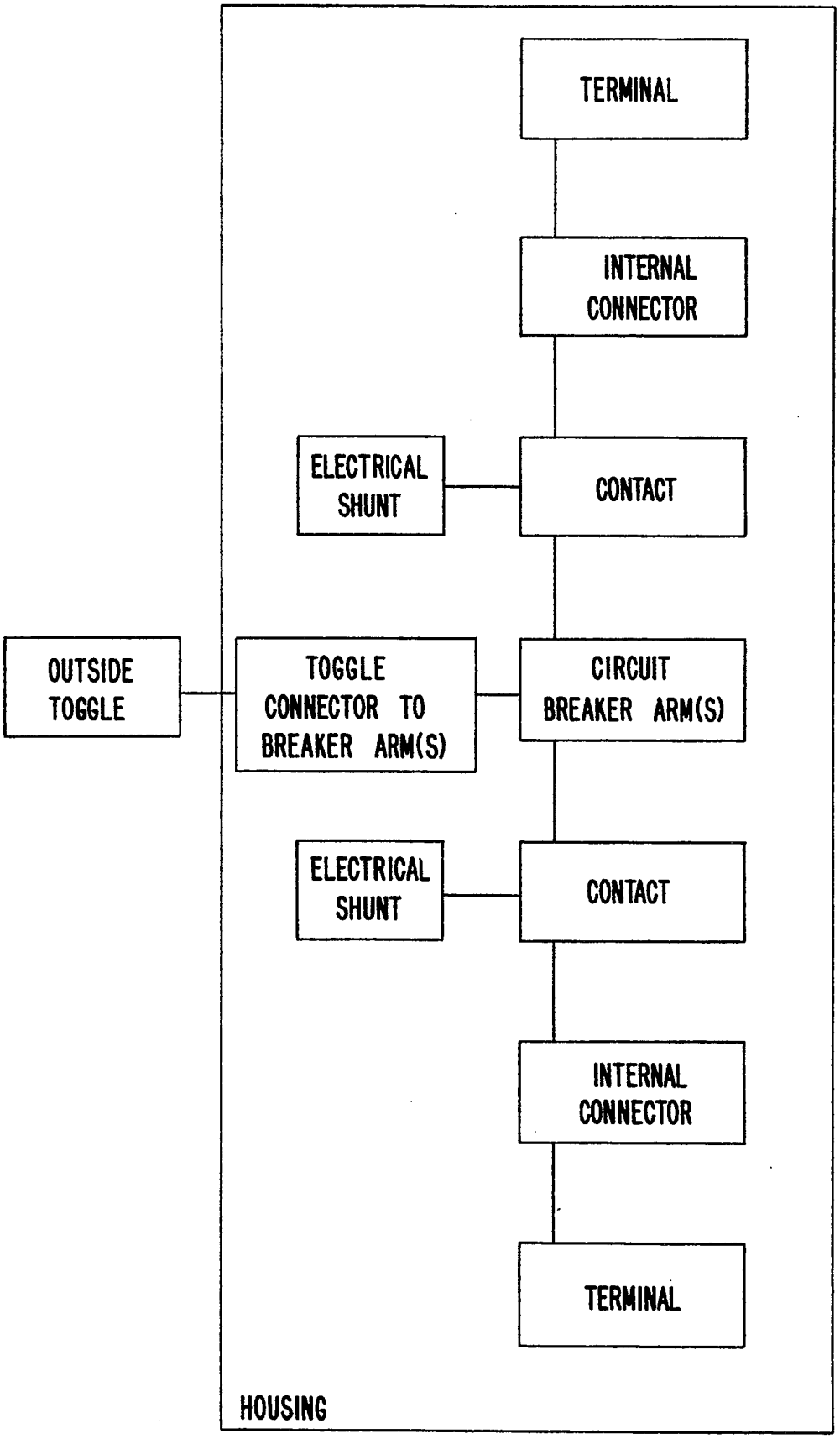
FIG. 1*c* schematically illustrates the internal components of a circuit breaker element.
Figure 2:
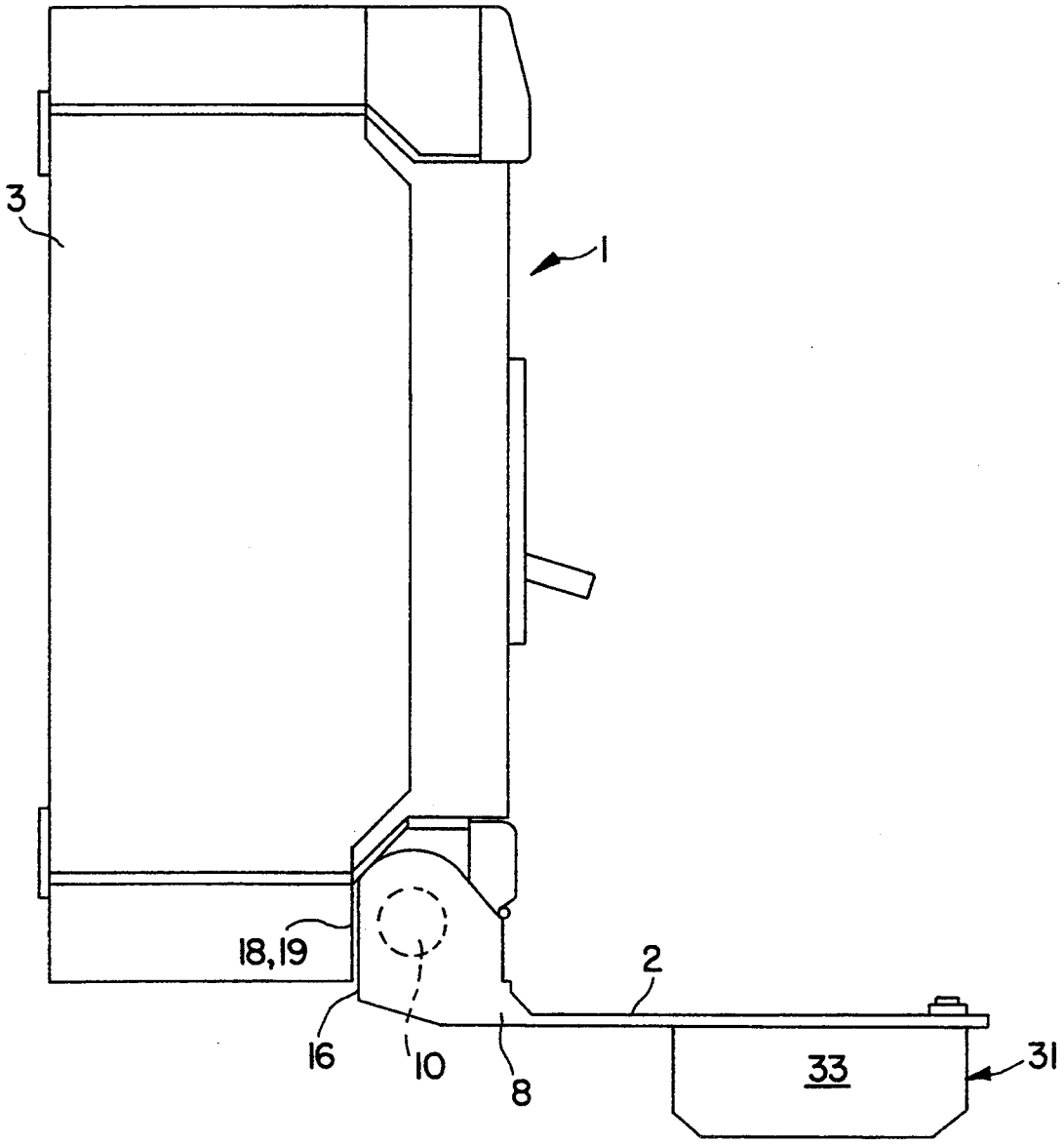
FIG. 2 shows a side view of the power circuit breaker with an open cover in the direction of arrow II in FIG. 1.
Figure 3:
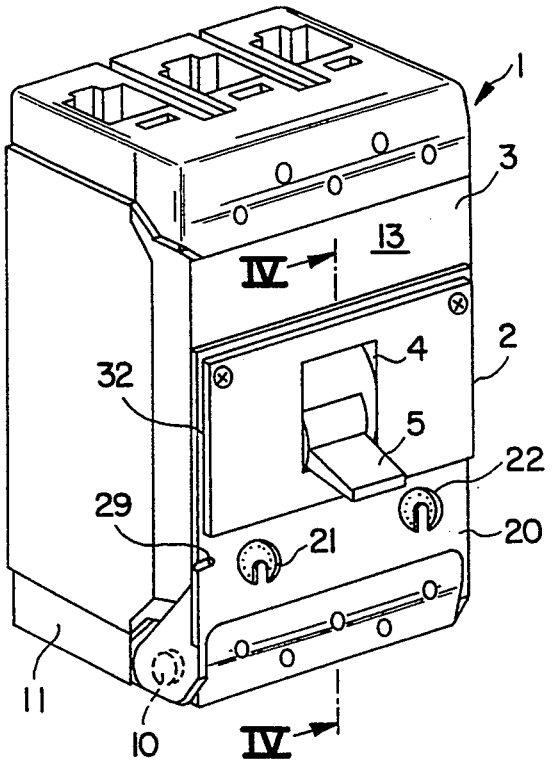
FIG. 3 shows a front perspective view of the power circuit breaker with a closed cover.
Figure 4:
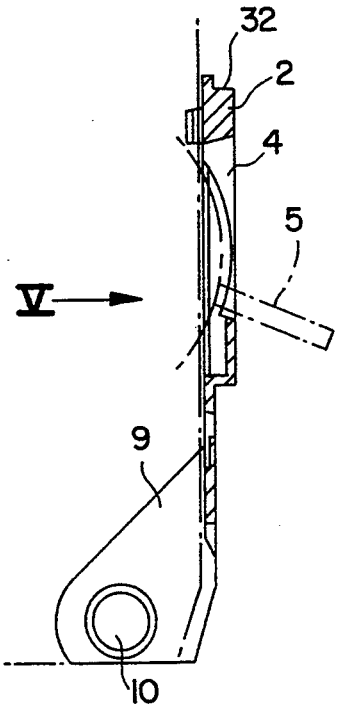
FIG. 4 shows a partial vertical section through the cover along line IV—IV in FIG. 3.
Figure 5:
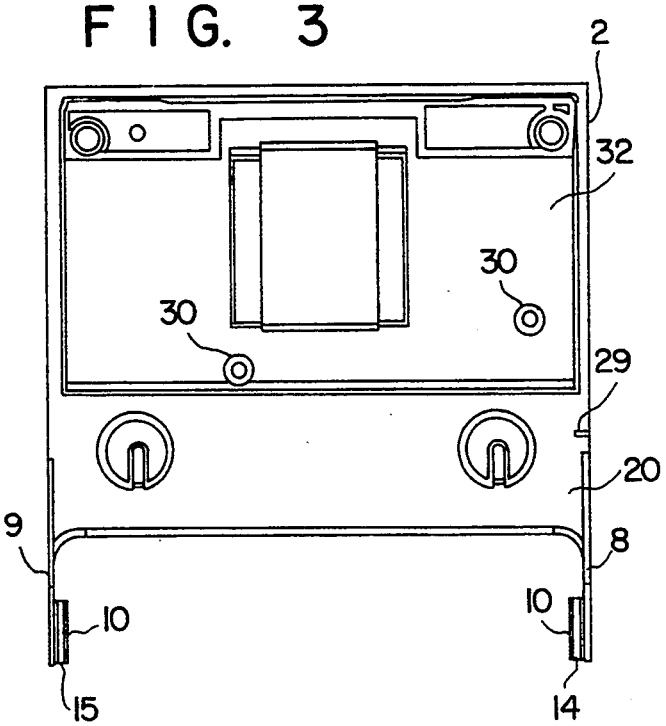
FIG. 5 is an inside view of the cover in the direction of arrow V in FIG. 4.
Figure 6:
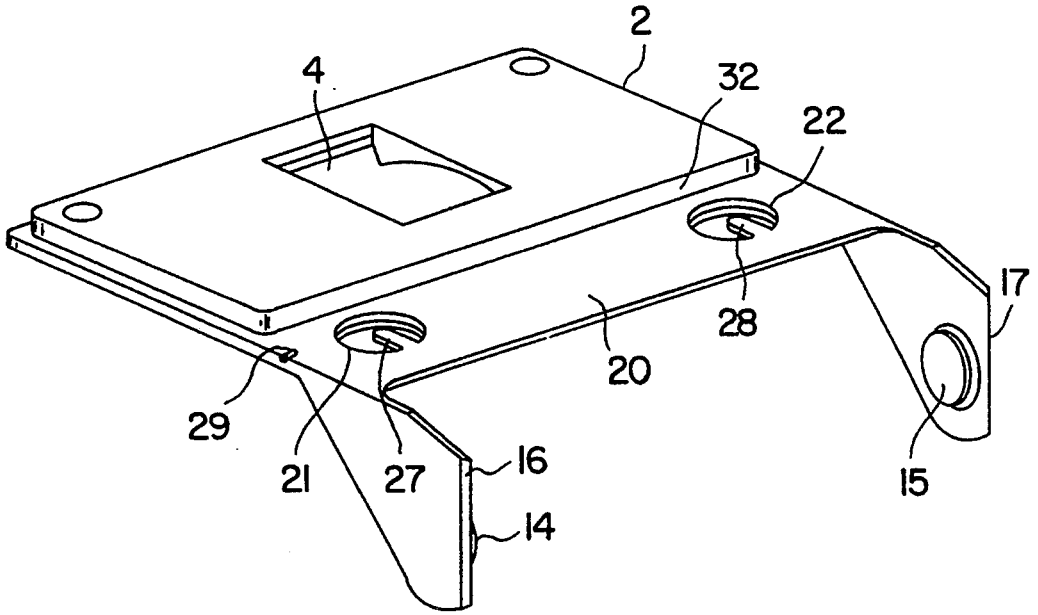
FIG. 6 shows a three-dimensional outside view of the cover.
Figure 7:
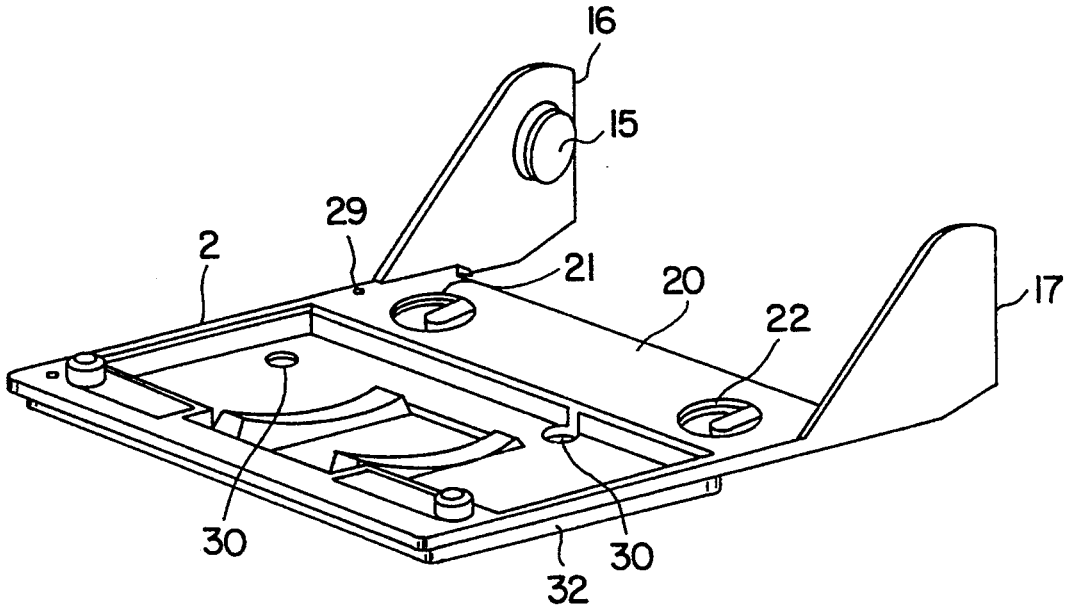
FIG. 7 shows a three-dimensional inside view of the cover.

FIGS. 1 to 3 show various electric switching devices with toggle lever actuators. As shown in FIG. 1, the switching device 1 can be a low voltage power circuit breaker, having a cover 2 on the front side of a breaker enclosure 3. FIG. 1*a* shows an alternative circuit breaker switch box of a simplified format. The switching device of FIG. 1*a* has space for the installation of two single circuit breakers 40, or one double circuit breaker (not shown). Alternatively, there could be provided connection spaces for a plurality of circuit breakers, depending on the use for which the box will be installed. FIG. 1*b* shows a further electrical switching device having a plug in type-switch, and FIG. 1*c* schematically represents several of the components and the circuitry which make up what could be another type of circuit breaker apparatus.

The circuit breaker box of FIG. 1*a* could represent a typical breaker box of possibly the simplest construction. This box preferably has a terminal bar 41 for receiving the ground wire 45 and the neutral wire 46 from a power supply feed 47. The terminal bar 41 can preferably have a number of terminal connections 42 which preferably have threaded screws for pressing the wires into contact with the bar 41, as are well known in the art. There can also preferably be a connection terminal 43 for receiving the "hot" or phase wire 48, and which can also be of the threaded screw type connection terminal. The phase current is conducted via the bar 49 to the connection terminal 50. The circuit breaker 40 has a first end which fits into a clip 52, and a slot 53, into which the connection terminal 50 snugly fits. The slot 53 would essentially have electrical contact plates for contacting the planar surfaces of the terminal 50. The circuit breaker 40 can also preferably have a terminal 55 for attaching an outgoing wire 56 thereto.

In typical installations, because of the danger posed by electrical current, the enclosure of FIG. 1*a* would have a cover (not shown) disposed thereon. Such a cover would preferably have a slotted opening to allow the breaker to be manually operated. The housing 58 can have recesses 60 for attachment of the cover.

FIG. 1*b* shows an alternate switching device which has a base connector 62 fastened into the housing 63. The base connector 62 essentially can provide all of the necessary electrical connection between the incoming wire 65 and the outgoing wire 66. This base connector can preferably have terminal portions 64 for receiving ingoing wires 65 and outgoing wires 66. The terminal portions 64 are connected to receiving contacts 67. A plug-in switch module 70 has contacts 71 that plug into receiving contacts 67. Such a switch device can also be equipped with a cover (not shown).

FIG. 1*c* schematically illustrates the construction of a circuit breaker element. As shown., some of these components include the terminal areas where attachment of the incoming or outgoing wires is made, and the contacts to which a circuit breaker is electrically connected. FIG. 1*c* also depicts the external accessibility of the toggle switch for operating the breaker, thereby alleviating any need for removing any cover when a circuit need to be opened or closed. Such a cover thereby provides protection from electric shock, while also providing convenient operation of the breaker without any danger to the operator.

One aspect of the invention resides in a low voltage circuit breaker for being disposed along a power supply line, which low voltage circuit breaker comprises: a housing defining an interior space therein and separating the interior space from an exterior space at least partially surrounding the housing, the housing having an opening therein from the interior space to the exterior space; a first terminal device for receiving at least one power supply line; a second terminal device for receiving at least one output power line; circuit breaker arm apparatus for disrupting flow of current between the at least one power supply line and the at least one output line, the circuit breaker arm apparatus having a first contact device for being connected to the first terminal device, and a second contact device for being connected to the output power line, the circuit breaker arm apparatus being configured for being connected between the first contact device and the second contact device for flow of current between the first contact device and the second contact device, and disconnected from at least one of the first contact device and the second contact device to disrupt flow of current between the first contact device and the second contact device; toggle am apparatus connected to the circuit breaker arm apparatus to move the circuit breaker am apparatus into connection between the first contact device and the second contact device and to disconnect the circuit breaker arm apparatus from the at least one of the first contact device and the second contact device; apparatus for connecting the first contact device to the second terminal device; apparatus for connecting the second contact device to the second terminal device; an electrical shunt device in contact with the first and the second contact device for drawing electrical current arcs; and an adjustable tripping apparatus for variably adjusting the tripping current, the adjustable tripping apparatus comprising a knob device for adjusting the tripping current, the knob device having reference indicators thereon for indicating a setting of the knob device; a cover for covering the opening of the housing, the cover having a first opening therethrough for passage of at least a portion of the toggle switch apparatus through the cover, and at least one second opening therethrough for viewing of the reference indicators of the knob device; and hinge apparatus for hingedly attaching the cover to the housing.

As shown in FIGS. 2–7, the cover 2 is preferably designed with a slot 4 for a toggle lever 5 of an switching mechanism 35. The cover can also preferably have fastening devices for receiving a mechanical rotary actuator 31 or a motor drive. The cover 2 can also be sized so that it covers the chambers 6, 7, which chambers can be equipped with shunt releases in contact with the contacts for drawing electrical current arcs and/or auxiliary switches 36, etc. These chambers 6 and 7 can be located on one or both sides of the toggle lever 5 within the breaker enclosure 3, or in any other convenient location within the enclosure.

As shown in particular by the isolated views of the cover 2 in FIGS. 4 to 7, the cover 2 can be designed with two parallel bearing legs 8, 9, which essentially can comprise flanges of the cover 2 which are preferably bent at about a 90 degree angle in relation to the plane of the cover. These bearing legs 8 and 9 preferably laterally overlap, or flank the breaker enclosure 3 in its lower region, when viewed in the orientation as shown in the drawings, so that the cover 2 can be pivoted downwardly away from the front side 13 of the breaker enclosure 3. This pivoting is preferably provided by means of a pivot bearing 10 formed by coaxially interlocking pivots and pivot bearing openings on the two bearing legs 8, 9, and on the two outside enclosure walls 11, 12.

The two parallel bearing legs 8, 9 of the cover 2 are preferably designed as elastic bearing clips which can be engaged with interlocking pivots and pivot bearing openings on the side walls 11, 12 of the breaker enclosure 3. For this pivot bearing 10, pivots can project coaxially outward from the side walls 11, 12 of the breaker enclosure 3, which are then interlocked in corresponding pivot bearing openings on the two bearing legs 8, 9. However, it is also possible that coaxial pivots 14, 15 (FIGS. 5 to 7) could extend inward from the bearing legs 8, 9, and engage corresponding pivot bearing openings on the side walls 11, 12 of the breaker enclosure 3. The flexibility of the legs allows the legs to be disengaged from the enclosure 3, by a slight bending of the legs away from the enclosure.

On the exterior, front face of the cover 2, there can preferably be a projecting step-shaped flat extension 32 thereon for attachment of a rotary actuator or a suitable motor drive for operating the toggle switch. This flat extension 32 preferably can also serve as a base for the housing 33 of the rotary actuator 31. The inside dimensions of the housing 33 of the rotary actuator 31 preferably correspond to the outside dimensions of the step-shaped extension 32, so that the housing overlaps the extension 32 on the edges.

The cover 2 can advantageously be made from an elastic, or in particular a deformation-resistant plastic, such as polycarbonate or polyester thermoplastic, and on its inside, on both sides of the slot 4 for the toggle lever 5 of the latching mechanism, has several openings 30 or holes for screws to fasten the rotary actuator 31 for the latching mechanism. These openings 30 can preferably be covered over on the front of cover by thin, film-like wall parts suitable for puncturing. Thus, if not needed, the openings 30 would not be visible from the outside of the cover, and if a rotary actuator were to be installed, the openings can then be punched through to allow for fastening of the rotary actuator.

In addition to the portion which covers the switching mechanism and the chambers 6, 7 for shunt releases and/or auxiliary switches, the cover 2 can preferably have a masking panel 20 for covering an additional electrical component 23. This additional electrical component 23 could be a release block, or adjustable tripping device which is located below the latching mechanism. This additional electrical component 23 could possibly have, for example, two rotary knobs 24, 25 for adjusting.-for example, a tripping current for the breaker. These knobs 24 and 25 may also have reference marks thereon and a slots 26 for receiving a screwdriver for turning the knobs. Alternatively, there could be a meter area (not shown) on this electrical component 23. The masking panel 20 can preferably have window-like openings 21, 22 to allow for reading of the settings of the reference marks on the rotary knobs 24, 25, or reading of the meter, when the cover 2 is closed. There can also be present, in the vicinity of the window-like openings 21 and 22, lugs 27 and 28 which can project into, or even across these openings 21 and 22 in a known manner. Thus, when the cover 2 is closed, the lugs 27 and 28 cover the screwdriver slots 26 on the rotary knobs 24, 25, thereby inhibiting unauthorized adjustment of the knobs when the cover is in the closed position.

The cover 2, on one of its two vertical long edges, can also have an opening 29 through which a sealing wire can be passed. This opening 29 in combination with the sealing wire provide a means of protecting the enclosure against unauthorized opening, as such a wire would need to be broken to gain access to the internal components of the enclosure. Further, visual inspection of the wire would readily enable one to determine if such an unauthorized access has been made. If the wire were found to be broken, a more detailed inspection of the internal components could then be performed.

For the limit stops for limiting movement of the cover 2 in the open position, as shown in FIG. 1 and FIG. 2, the bearing legs 8, 9 can have edge stops 16, 17 on the end of the legs. These leg stops can preferably be disposed at about a 90 degree angle in relation to the cover front. These stops 16 and 17, when the cover 2 is opened to the horizontal, would come into contact against matching vertical stops 18, 19 (FIGS. 1 and 2) on the side walls 11, 12 of the breaker enclosure 3, and would hold the cover in such a horizontal position. The side walls 11 and 12 can also preferably be recessed in relation to the front side 13 of the breaker enclosure 3 in the vicinity of the interlocking pivots and pivot bearing openings for the bearing legs 8 and 9.

Further, if other opening angles were desired, such as, for example about 120°, the edge stops could be disposed at a corresponding angle of about 60° with respect to the plane of the front cover. And, if it were desired to not have any limit stops at all, the bearing legs and recessed portions of the cover could be configured so that no contact occurs between the bearing legs and the edges of the recessed portion of the cover. If no stop limits were desired, the side walls could essentially be straight walls without recessed portions, and the bearing legs 8 and 9 could simply clip onto the non-recessed side walls.

One feature of the invention resides broadly in the cover for the front side of electrical switching devices with toggle lever actuators, in particular low voltage power circuit breakers, with a slot-like opening for the toggle lever of the latching mechanism, with fastening devices for a mechanical rotary actuator or a motor drive, and to cover the chambers for shunt releases and/or auxiliary switches etc. located on both sides of the toggle lever on the breaker enclosure, characterized by the fact that the cover 2 is designed with bearing legs 8, 9 which are bent at an angle of 90 degrees in relation to the cover plane, which are parallel to one another and laterally overlap the breaker enclosure 3, by means of which the cover is mounted by means of a pivot bearing 10 with coaxially interlocking pivots and pivot bearing openings on the breaker enclosure 3 so that it can swing out.

Another feature of the invention resides broadly in the cover, characterized by the fact that the bearing legs 8, 9 are designed as elastic bearing clips, which can be engaged with the interlocking pivots and pivot bearing openings on the side walls 11, 12 of the breaker enclosure 3.

Yet another feature of the invention resides broadly in the cover, characterized by the fact that the cover 2 in the vicinity of the fastening of the rotary actuator 31 has a step-shaped projecting flat extension 32 as a floor for the housing 33 of the rotary actuator 31.

Still yet another feature of the invention resides broadly in the cover, characterized by the fact that the inside dimensions of the housing 33 of the rotary actuator 31 correspond to the outside dimensions of the step-shaped extension 32, such that the housing 33 overlaps the extension 32 on the edges.

Yet still another feature of the invention resides broadly in the cover, characterized by the fact that on the inside of the step-shaped extension 32, on both sides of the recess for the toggle lever 5 of the latching mechanism, it has several openings 30 or holes for screws for fastening the rotary actuator 31 for the latching mechanism, which are closed toward the front of the cover by means of thin, film-like wall parts suitable for puncturing.

Still another feature of the invention resides broadly in the cover, characterized by the fact that below the cover of the latching mechanism and the cheers 6, 7 for shunt releases and/or auxiliary switches, it has a masking panel 20 with window-like openings 21, 22 for reading the settings on a release block 23 located below the latching mechanism.

Another feature of the invention resides broadly in the cover, characterized by the fact that on one of its two long edges, it has an opening 29 for the passage of a sealing wire.

Still yet another feature of the invention resides broadly in the cover, characterized by the fact that it consists of an elastic, deformation-resistant plastic, such as polycarbonate or polyester thermoplastic.

Yet another feature of the invention resides broadly in the cover, characterized by the fact that the bearing legs 8, 9 have terminal edge stops 16, 17 bent at an angle in relation to the front of the cover which, when the cover 2 is opened to the horizontal, come in contact against vertical matching edge stops 18, 19 on the side walls 11, 12 of the breaker enclosure 3, which are recessed in relation to the front side 13 of the breaker enclosure 3 next to the interlocking pivots and pivot bearing openings for the bearing legs 8, 9.

Several types of circuit breakers and the components which comprise the circuit breakers are described in the following U.S. Pat. Nos. 4,750,375 to Godesa, entitled "Drive Device for a Circuit Breaker with a Ratchet Wheel"; No. 4,678,873 to Preuss and Berndt, entitled "Low Voltage Circuit Breaker Having a Switching Mechanism Arranged in a Separate Chamber"; No. 4,380,785 to Demeyr and Claudin, entitled "Solid State Trip Unit for an Electrical Circuit Breaker"; No. 4,695,913 to Terracol and Roulet, entitled "Shunt Effect Low Voltage Circuit Breaker"; No. 5,077,628 to Neuhouser, entitled "Circuit Breaker Protection Apparatus"; No. 4,742,321 to Nagy et al., entitled "Molded Case Circuit Breaker with Accessory Function"; No. 4,211,906 to Habedank and Troebel, entitled Rotary Actuating Device for Low-Voltage Circuit Breakers with Toggle Lever"; and No. 4,636,760 to Lee, entitled "Low Voltage Circuit Breaker with Remote Switching Function".

All, or substantially all, of the components and methods of the various embodiments may be used with at least one embodiment or all of the embodiments, if any, described herein.

All of the patents, patent applications and publications recited herein, if any, are hereby incorporated by reference as if set forth in their entirety herein.

The details in the patents, patent applications and publications may be considered to be incorporable, at applicant's option, into the claims during prosecution as further limitations in the claims to patentably distinguish any amended claims from any applied prior art.

The appended drawings, in their entirety, including all dimensions, proportions and/or shapes in at least one embodiment of the invention, are, if applicable, accurate and to scale and are hereby incorporated by reference into this specification.

The invention as described hereinabove in the context of the preferred embodiments is not to be taken as limited to all of the provided details thereof, since modifications and variations thereof may be made without departing from the spirit and scope of the invention.

What is claimed is:

1. An electrical switching device for being disposed along a power supply line, said electrical switching device comprising:

housing means, said housing means defining an interior space therein and separating the interior space from an exterior space at least partially surrounding the housing means, said housing means having an opening therein from the interior space to the exterior space;

first terminal means for receiving at least one power supply line;

second terminal means for receiving at least one output power line;

switch means for disrupting flow of current between the at least one power supply line and the at least one power output line, said switch means having a first position for connecting between the at least one power supply line and the at least one power output line, and a second position for disconnecting the at least one power supply line and the at least on output power line;

toggle arm means connected to said switch means to move said switch means into said first connecting position and said second disconnecting position;

cover means for covering the opening of said housing means, said cover means having a first opening therethrough for passage of at least a portion of said toggle arm means through said cover means;

hinge means for hingedly attaching said cover means to said housing means;

said housing means comprises chambers therein, at least one of said chambers being configured for receiving at least one of:

at least one shunt release, at least one auxiliary switch, and at least one adjustable tripping device, said cover means being configured for covering each of said chambers in said housing means;

said cover means further comprises attachment means for attaching one of:

a mechanical rotary actuator, and a motor drive to said cover means, said attachment means being disposed about said opening of said cover means for engagement of one of: a mechanical rotary actuator and a motor drive with said toggle arm means;

said cover means comprises a first and a second leg portion extending away from said cover means, said first and said second leg portion being disposed substantially perpendicularly to said cover means and substantially parallel to one another;

said first and said second leg portion being configured for overlapping at least a part of said housing means;

said first and said second leg portion each have a first end disposed adjacent said cover means, and a second end disposed opposite said first end;

said second end of each of said first and said second leg portion being coaxially attached to said housing means by said hinge means;

said hinge means comprise a pivot bearing, said pivot bearing comprising a projection for being disposed in and interlocking with an opening;

one of:

said at least a part of said housing means, and said second end of said leg portion comprise said projection of said pivot bearing; and the other of:

said at least a part of said housing means, and said second end of said leg portion comprise said opening for receipt of said pivot projection.

2. The electrical switching device according to claim 1, wherein:

said housing means comprises a base portion and side walls extending from said base portion;

said first and second leg portions of said cover means overlap said side walls of said housing, and said side walls comprise said one of:

said pivot projection, and said pivot opening for receipt of said pivot projection; and said first and second leg portions comprise elastic clips having an elasticity for engagement and disengagement of said pivot projection and said pivot opening.

3. The electrical switching device according to claim 2, wherein:

said electrical switching device comprises a low voltage circuit breaker;

said switch means comprises circuit breaker arm means for disrupting flow of current between the at least one power supply line and the at least one output line, said circuit breaker arm means having first contact means for being connected to said first terminal means, and second contact means for being connected to said output power line, said circuit breaker arm means being configured for being connected between said first contact means and said second contact means for flow of current between said first contact means and said second contact means, and disconnected from at least one of said first contact means and said second contact means to disrupt flow of current between said first contact means and said second contact means;

said toggle arm means being connected to said circuit breaker arm means to move said circuit breaker arm means into said connection between said first contact means and said second contact means and to disconnect said circuit breaker arm means from said at least one of said first contact means and said second contact means;

said breaker means further comprises:

means for connecting said first contact means to said first terminal means; and means for connecting said second contact means to said second terminal means;

said attachment means comprises a projecting surface disposed on said cover means, said projecting surface having an outside dimension and one of: a rotary actuator, and a motor drive having an inside dimension; and said outside dimension of said projecting surface substantially corresponding to the inside dimension of one of: a rotary actuator, and a motor drive for overlapping of one of: a rotary actuator, and a motor drive about said projecting surface.

4. The low voltage circuit breaker means according to claim 3, wherein:

said circuit breaker means further comprises:

electrical shunt means in contact with said first and said second contact means for drawing electrical current arcs; and adjustable tripping means for variable adjusting the tripping current, said adjustable tripping means comprising knob means for adjusting the tripping current, said knob means having reference indicators thereon for indicating a setting of said knob means;

said cover means comprising at least one second opening therethrough for viewing of the reference indicators of the knob means;

said cover means further comprises additional openings therethrough in the vicinity of said projecting surface;

said additional openings being for receipt of fastening means therethrough for fastening a rotary actuator to said cover means; and said additional openings being covered by a punctur-able sheet.

5. The low voltage circuit breaker means according to claim 4, wherein said cover means further comprises an opening for receipt of a sealing wire therethrough, said sealing wire for sealing said cover means in the closed position.

6. The low voltage circuit breaker means according to claim 5, wherein said cover comprises an elastic, deformation-resistant plastic.

7. The low voltage circuit breaker means according to claim 6, wherein said elastic, deformation-resistant plastic comprises one of:

polycarbonate, and polyester thermoplastic.

8. The low voltage circuit breaker means according to claim 7, wherein:

said second end of each of said first and said second leg portions comprise terminal edge stops disposed angularly with respect to said cover means;

said wall portions comprise recessed portions for receipt of said second end portion of said first and said second leg portions, said recessed portions comprising edge stops for engaging said edge stops of said leg portions upon pivoting of said cover means a predetermined distance.

9. The low voltage circuit breaker means according to claim 7, wherein:

said base portion of said housing has a longitudinal dimension;

said cover means has a first, open position disposed at substantially 90° with respect to said housing and a second, closed position disposed substantially parallel to said base portion of said housing and covering said housing opening;

said first and second leg portions comprise said pivot projections adjacent said second end of said first and second leg portions;

said recessed portions of said wall portions comprise said pivot openings for receiving said cover means has a width dimension extending between said first and second leg portions, and a height dimension substantially perpendicular to said width dimension;

said first and second leg portions extend away from said cover means in a direction substantially perpendicular to both said width dimension and said height dimension and further extend away from said cover means in a direction substantially parallel to said height dimension of said cover means;

said first and second leg portions each comprise substantially triangular-shaped flange extending away from said cover means, said flanges having:

a first side forming said first end of said leg portions adjacent said cover means;

a second side substantially perpendicular to said first side and extending from said first end to said second end of said leg portions at a position away from said cover means; and a third side extending from said first end to said second end and at an angle of about 45° with respect to said first side;

said second end of said first and second leg portions are rounded Between said second and third sides;

said recessed portions of said housing wall portions have a first edge disposed substantially parallel to said longitudinal dimension of said base portion of said housing, and a second edge disposed substantially perpendicularly to said housing, and a second edge said first edge comprises said edge stop of said recessed portions;

said second side of said flange forms said first and second leg portions comprising said edge stop of said first and second leg portions;

said second side of said flange of said first and second leg portions is disposed substantially parallel to and in contact with said first edge of said recessed portions in said first, open position of said cover means;

said second side of said flange of said first and second leg portions is disposed substantially perpendicularly to said first edge of said recessed portions in said second, closed position of said cover means;

said knob means of said adjustable tripping means comprise a slot therein, said slot being configured for receipt of a screwdriver therein for turning of said knobs; and said second openings of said cover means comprises lugs for covering said slots of said knob means when said cover means is in the closed position.

10. Low voltage circuit breaker means for being disposed along a power supply line said low voltage circuit breaker means comprising:

housing means, said housing means defining an interior space therein and separating the interior space from an exterior space at least partially surrounding the housing means, said housing means having an opening therein from the interior space to the exterior space;

first terminal means for receiving at least one power supply line;

second terminal means for receiving at least one output power line;

circuit breaker arm means for disrupting flow of current between the at least one power supply line and the at least one output line, said circuit breaker arm means having first contact means for being connected to said first terminal means, and second contact means for being connected to said output power line, said circuit breaker arm means being configured for being connected between said first contact means and said second contact means for flow of current between said first contact means and said second contact means, and disconnected from at least one of said first contact means and said second contact means to disrupt flow of current between said first contact means and said second contact means;

toggle arm means connected to said circuit breaker arm means to move said circuit breaker arm means into said connection between said first contact means and said second contact means and to disconnect said circuit breaker arm means from said at least one of said first contact means and said second contact means;

means for connecting said first contact means to said first terminal means;

means for connecting said second contact means to said second terminal means;

electrical shunt means in contact with said first and said second contact means for drawing electrical current arcs;

adjustable tripping means for variably adjusting the tripping current, said adjustable tripping means comprising knob means for adjusting the tripping current, said knob means having reference indicators thereon for indicating a setting of said knob means;

cover means for covering the opening of said housing means, said cover means having a first opening therethrough for passage of at least a portion of said toggle switch means through said cover means, and at least one second opening therethrough for viewing of the reference indicators of the knob means;

hinge means for hingedly attaching said cover means to said housing means;

said cover means comprises a first and a second leg portion extending away from said cover means, said first and said second leg portion being disposed substantially perpendicularly to said cover means and parallel to one another;

said first and said second leg portion being configured for overlapping at least a part of said housing means;

said first and said second leg portion each have a first end disposed adjacent said cover means, and a second end disposed opposite said first end;

said second end of each of said first and said second leg portion being coaxially attached to said housing means by said hinge means;

said hinge means comprise a pivot bearing, said pivot bearing comprising a projection for being disposed in and interlocking with an opening;

one of:

said at least a part of said housing means, and said second end of said leg portion comprise said projection of said pivot bearing;

the other of:

said at least a part of said housing means, and said second end of said leg portion comprise said opening for receipt of said pivot projection;

said housing means comprises a base portion and side walls extending from said base portion;

said first and second leg portions of said cover means overlap said side walls of said housing, and said side walls comprise said one of:

said pivot projection, and said pivot opening for receipt of said pivot projection;

said first and second leg portions comprise elastic clips having an elasticity for engagement and disengagement of said pivot projection and said pivot opening;

said cover means further comprises attachment means disposed adjacent said first opening, said attachment means being configured for attachment of a rotary actuator to said cover means;

said attachment means comprises a projecting surface disposed on said cover means, said projecting surface having an outside dimension and a rotary actuator having an inside dimension; and said outside dimension of said projecting surface substantially corresponding to an inside dimension of a rotary actuator for overlapping of a rotary actuator about said projecting surface.

11. An enclosure for an electrical switching device, the enclosure comprising:

a first enclosure portion, the first enclosure portion comprising;

a base portion;

a plurality of side wall portions extending substantially perpendicularly from the base portion, the side wall portions having a first edge for being disposed adjacent the base portion and a second edge disposed away from the base portion, the side wall portions and the base portion defining an interior of the enclosure, the interior for housing at least one electrical switching device, and the second edge of the side wall portions defining an opening for access to the interior of the enclosure;

cover means for closing the opening of the first enclosure portion, said cover means having a closed position adjacent the second edge of the side walls and an open position away from the second edge of the side walls, and said cover means comprising an opening therein, said opening in said cover means being configured for providing exterior access to an electrical switching device disposed in said interior of said enclosure when said cover means is in the closed position;

hinge means for hingedly attaching said cover means to the first enclosure portion for pivoting of said cover means towards and away from said first enclosure portion to open and close said opening; and said cover means further comprises fastening means for fastening one of:

a mechanical rotary actuator, and a motor drive to said cover means adjacent said opening of said cover means.

12. The enclosure for an electrical switching device according to claim 11, wherein:

said cover means comprises a first leg portion extending away from said cover means and a second leg portion extending away from said cover means, said first and said second leg portions being disposed substantially perpendicularly to said cover means and parallel to one another;

said first and said second leg portions each have a first end disposed adjacent said cover means, and a second end disposed opposite said first end;

said first end of each of said first and said second leg portions being configured for overlapping at least a part of said side wall portions of said enclosure;

said first end of each of said first and said second leg portions being coaxially hinged to said at least a part of said side wall portions by said hinge means;

said hinge means comprise a pivot bearing, said pivot bearing comprising a projection for being disposed in and interlocking with an opening;

one of:

said at least a part of said side wall portions, and said second end of said leg portion comprise said projection of said pivot bearing; and the other of:

said at least a part of said side wall portions, and said second end of said leg portion comprise said opening for receipt of the pivot projection.

13. The enclosure for an electrical switching device according to claim 12, further including:

said enclosure comprising chambers therein in the interior space thereof, one of said chambers being configured for receiving a switching device, the switching device having at least one first electrical contact surface for contacting an incoming power supply line, at least one second electrical contact surface for contacting an outgoing power supply line, and switch means for connecting and disconnecting said at least one first electrical contact surface and said at least one second electrical contact surface, the switch means having a toggle arm extending therefrom for operating said switch means, and additional ones of said chambers being configured for receiving at least one of:

shunt releases, auxiliary switches, and adjustable tripping devices, the adjustable tripping devices comprising adjustable knobs having indicator marks thereon for adjusting the adjustable tripping device; said cover means being configured for covering each of said chambers in said housing means; and said fastening means being disposed about said opening of said cover means to engage and maintain one of: a mechanical rotary actuator, and a motor drive with a toggle arm of a switching device in said interior of said enclosure through said opening of said cover means.

14. The enclosure for an electrical switching device according to claim 13, wherein:

said first and said second leg portions comprise elastic bearing clips, said first and said second leg portions having an elasticity for engagement and disengagement of said pivot projection and said pivot opening.

15. The enclosure for an electrical switching device according to claim 14, wherein:

said cover means defines an interior surface for being disposed towards the interior of said enclosure, and an exterior surface for being disposed away from the interior of said enclosure;

said fastening means for fastening one of:

a mechanical rotary actuator, and a motor drive to said cover means comprises a step-shaped projecting surface projecting away from said exterior surface of said cover means.

16. The enclosure for an electrical switching device according to claim 15, wherein a rotary actuator has a housing means, the housing means having an internal dimension:

said step-shaped projecting surface has an external dimension; and said external dimension of said step-shaped projection substantially corresponds to said inside dimension of a housing of a rotary actuator; and said step-shaped projection being configured to be overlapped by a housing of a rotary actuator.

17. The enclosure for an electrical switching device according to claim 16, wherein said cover means comprises additional openings therethrough, said additional openings being configured for passage therethrough of fastening devices for fastening a rotary actuator to said cover means, said additional openings being covered on said external surface of said cover means by a puncturable sheet.

18. The enclosure for an electrical switching device according to claim 17, wherein:

said enclosure further comprises sealing wire means for sealing said covet means in the closed position; and said cover means further comprises:

window openings therein, said window openings being configured for viewing therethrough the settings of an adjustable tripping device; and an opening for receipt of the sealing wire means for sealing said cover means in the closed position.

19. The enclosure for an electrical switching device according to claim 18, wherein:

said cover comprises an elastic, deformation-resistant plastic;

said second end of each of said first and said second leg portions comprises terminal edge stops disposed angularly with respect to said cover means; and said wall portions comprise recessed portions for receipt of said second end portion of said first and said second leg portions, said recessed portions comprising edge stops for engaging said edge stops of said leg portions upon a pivoting of said cover means over a predetermined distance.

20. The enclosure for an electrical switching device according to claim 19, wherein, said elastic, deformation-resistant plastic comprises one of:

polycarbonate, and polyester thermoplastic;

said base portion of said first enclosure portion has a longitudinal dimension;

said cover means in said open position is disposed at longitudinal dimension;

said cover means in said open position is disposed at substantially 90° with respect to said first enclosure portion, and said cover means in said closed position is disposed substantially parallel to said base portion of said first enclosure portion;

said first and second leg portions comprise said pivot projections adjacent said second end of said first and second leg portions;

said recessed portions of said wall portions comprise said pivot openings for receiving said pivot projections therein;

said cover means has a width dimension extending between said first and second leg portions, and a height dimension substantially perpendicular to said width dimension;

said first and second leg portions extend away from said cover means in a direction substantially perpendicular to both said width dimension and said height dimension and further extend away from said cover means in a direction substantially parallel to said height dimension of said cover means;

said first and second leg portions each comprise substantially triangular-shaped flanges extending away from said cover means, said flanges having:

a first side forming said first end of said leg portions adjacent said cover means;

a second side substantially perpendicular to said first side and extending from said first end to said second end of said leg portions at a position away from said cover means; and a third side extending from said first end to said second end and at an angle of about 45° with respect to said first side;

said second end of said first and second leg portions are rounded between said second and third sides;

said recessed portions of said side walls have a first edge disposed substantially parallel to said longitudinal dimension of said base portion of said first enclosure portion, and a second edge disposed substantially perpendicularly to said first edge;

said first edge comprises said edge stop of said recessed portions;

said second side of said flange forms said first and second leg portions comprising said edge stop of said first and second leg portions;

said second side of said flange of said first and second lee portions is disposed substantially parallel to end in contact with said first edge of said recessed portions in said first, open position of said cover means;

said second side of said flange of said first and second leg portions is disposed substantially perpendicularly to said first edge of said recessed portions In said second, closed position of said cover means; and said window openings of said cover means comprise projections extending at least partially across said window openings for covering slot means of said adjustable tripping devices when said cover means is in the eloped position.

* * * * *

UNITED STATES PATENT AND TRADEMARK OFFICE

CERTIFICATE OF CORRECTION

PATENT NO. : 5,362,933

DATED : November 8, 1994

INVENTOR(S) : Wolfgang KUTSCHE, Wolfgang KREMERS, Andreas BALDEWEIN, Gerd HENTSCHEL, and Gerd VOISS It is certified that error appears in the above-indentified patent and that said Letters Patent is hereby corrected as shown below:

In column 5, line 55, after 'toggle', delete "am" and insert --arm--.

In column 5, line 56, after the second occurrence of 'breaker', delete "am" and insert --arm--.

In column 11, line 40, Claim 4, after 'for', delete "variable" and insert --variably--.

In column 12, line 26, Claim 9, after 'receiving' insert --said pivot projections therein;--.

In column 12, line 38, Claim 9, after 'triangular-shaped', delete "flange" and insert --flanges--.

In column 12, lines 55-56, Claim 9, after 'said', delete "housing, and a second edge" and insert --first edge;--.

In column 16, line 47, Claim 18, after 'said', delete "covet" and insert --cover--.

In column 17, lines 9-10, Claim 20, after 'dimension;' delete "said cover means in said open position is disposed at longitudinal dimension;".

UNITED STATES PATENT AND TRADEMARK OFFICE

CERTIFICATE OF CORRECTION

PATENT NO. : 5,362,933

DATED : November 8, 1994

INVENTOR(S) : Wolfgang KUTSCHE, Wolfgang KREMERS, Andreas BALDEWEIN, Gerd HENTSCHEL, and Gerd VOISS It is certified that error appears in the above-indentified patent and that said Letters Patent is hereby corrected as shown below:

In column 18, line 22, Claim 20, after 'to', delete "end" and insert --and--.

In column 18, line 35, Claim 20, after 'the', delete "eloped" and insert --closed--.

Signed and Sealed this

Twenty-ninth Day of April, 1997

*Attest:*

*Attesting Officer*

Bruce Lehman

BRUCE LEHMAN

*Commissioner of Patents and Trademarks*